US008024996B2

(12) United States Patent
Wagner et al.

(10) Patent No.: US 8,024,996 B2
(45) Date of Patent: Sep. 27, 2011

(54) POWER WRENCH

(75) Inventors: Paul-Heinz Wagner, Much-Birrenbachshöhe (DE); Bernd Thelen, Much (DE); Andreas Niemietz, Much (DE); Klaus Rüssmann, Königswinter (DE)

(73) Assignee: Wanger Vermögensverwaltungs-GmbH & Co. KG, Much (DE)

( * ) Notice: Subject to any disclaimer, the term of this patent is extended or adjusted under 35 U.S.C. 154(b) by 184 days.

(21) Appl. No.: 12/225,433

(22) PCT Filed: Mar. 20, 2007

(86) PCT No.: PCT/EP2007/052657

§ 371 (c)(1), (2), (4) Date: Sep. 22, 2008

(87) PCT Pub. No.: WO2007/107575

PCT Pub. Date: Sep. 27, 2007

(65) Prior Publication Data

US 2009/0107298 A1 Apr. 30, 2009

(30) Foreign Application Priority Data

Mar. 21, 2006 (DE) ..... 20 2006 004 380 U

(51) Int. Cl.
*B25B 13/46* (2006.01)

(52) U.S. Cl. ..... 81/57.39; 81/63

(58) Field of Classification Search ..... 81/57.39, 81/54, 63

See application file for complete search history.

(56) References Cited

U.S. PATENT DOCUMENTS

| | | | | |
|---|---|---|---|---|
| 7,069,819 | B2 * | 7/2006 | Albertson et al. | 81/57.39 |
| 2005/0087041 | A1 * | 4/2005 | Albertson et al. | 81/57.39 |

FOREIGN PATENT DOCUMENTS

| | | |
|---|---|---|
| DE | 40 28 950 A1 | 4/1991 |
| GB | 2 028 204 A | 3/1980 |

* cited by examiner

*Primary Examiner* — Debra S Meislin

(74) *Attorney, Agent, or Firm* — Miles & Stockbridge P.C.; David R. Schaffer, Esq.

(57) ABSTRACT

The invention relates to a hydraulic power wrench comprising a ratchet lever (16) driven by a hydraulic cylinder. According to the invention, said power wrench is provided with a friction brake (20) which operates continuously between the housing (10) and the output shaft (14). In this way, reversed rotations of the output shaft following the individual working strokes are avoided.

8 Claims, 7 Drawing Sheets

POWER WRENCH

BACKGROUND OF THE INVENTION

The invention refers to a power wrench with a drive portion including a hydraulic cylinder, and a driven portion, the driven portion comprising a output shaft rotatably supported in a housing and rotated at intervals by a ratchet lever.

Hydraulic power wrenches are known that work based on the ratchet lever principle. When appropriately high hydraulic pressures are applied, such power wrenches can be used for very high torques. After a stroke of the hydraulic piston/cylinder unit, the output shaft tends to rotate backward by a small angle. This is due to the fact that the screw structure partly relaxes after each working stroke. To prevent such a relaxation, it is already known to have a blocking member engage the output shaft, the blocking member engaging an outer toothing of the output shaft, thereby preventing backward rotation. This entails the disadvantage of a safety risk caused by unreliable retaining systems. When the hydraulic unit that supplies pressure to the power screw driver is stopped, or in the event of a power breakdown or an incomplete stroke length, the apparatuses may come clear of the screw to be turned during the working process. This means a risk of accidents. Apparatuses with retaining latch systems may become twisted after the end moment has been reached and have to be detached tediously from the object to be screwed. The power wrench has to be brought up again to the maximum torque set and may lead to torque inaccuracies. After every stroke, the full clamping force is again applied to the apparatus and the screw bolt connection. This gives rise to high loads in the system and to constant bending stresses at the screw connection.

SUMMARY OF THE INVENTION

It is an object of the invention to provide a power wrench that allows for a uniform tightening of screws without any safety risks.

The power wrench comprises a continuously operative friction brake causing a friction force between the drive shaft and the housing. This friction force is generated permanently and is overcome by the hydraulic drive during the working stroke. The friction brake causes a uniform tightening of the screw. It allows a fitter to control several screwing operations performed with power wrenches at the same time. The power wrench is reliably positioned and is held securely in every working position, regardless of the phase of the respective stroke. No stepped latching takes place. The retaining system is active all the time. It is not necessary to switch the hydraulic system on and off. Neither do any additional bending moments act on the screw connection as is true for systems with a locking latch. The screwing tool will not jam after the last stroke. Therefore, time-consuming loosening work is eliminated. A secure removal of the apparatus is guaranteed. Since no latching and unlatching occurs, the apparatus is secured in any optional working position.

The friction brake may comprise at least one friction shoe arranged substantially radially with respect to the output shaft and pressing against a circumferential friction surface. Preferably, the friction surface is provided at the output shaft or a component connected therewith. However, it is also possible to provide the friction shoe on the output shaft and to make it act on a friction surface of the housing. A plurality of circumferentially distributed friction shoes may be provided. Preferably, each friction shoe is urged against the drive shaft by means of an adjustable tensioning device. In this manner, the friction brake can be readjusted or adjusted. The tensioning device preferably comprises a tensioning wedge.

In a development of the invention, it is provided for an axially operating friction brake that the friction brake has a flange of the drive shaft that presses against a friction member stationarily provided at the housing. The friction force acting on the flange brakes the output shaft.

Preferably, a spring is provided that presses the output shaft towards the friction member. The friction member can be connected with a swivel ring in a manner secured against rotation, the ring pressing axially against the spring via the axial bearing.

According to another aspect of the invention, the housing of a power wrench of the type mentioned above is provided with a frictionally retained rotatable index ring arranged concentrically with the drive shaft, the index ring having a centric window through which a mark on the output shaft is visible. Such an index ring may be used to indicate the rotational angle of the output shaft. The index ring is first set to the respective position of the mark by manual rotation, so as to memorize the initial position. During the screwing process, the mark will wander relative to the index ring, so that the respective screwing angle van easily be read.

The following is a detailed description of embodiments of the invention made with reference to the drawings.

DETAILED DESCRIPTION OF THE PREFERRED EMBODIMENTS

Figure 1:
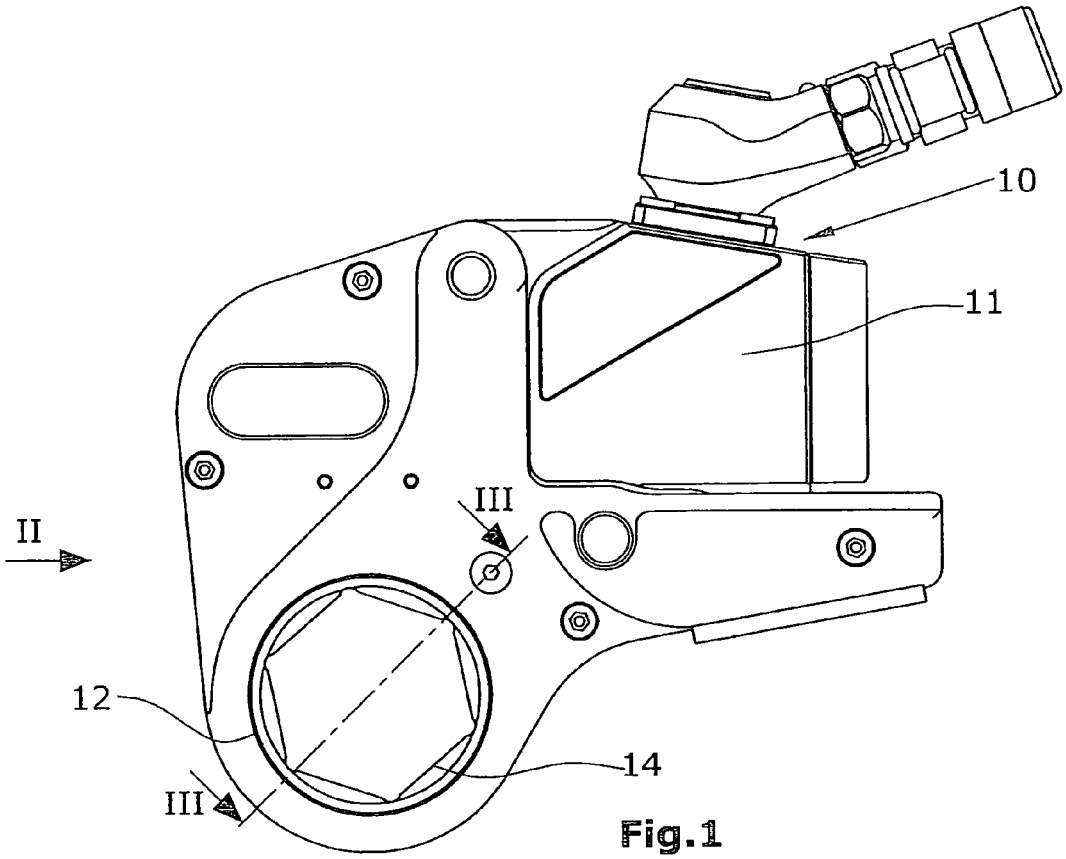
FIG. 1 is a side elevational view of a first embodiment of the power wrench.
Figure 2:
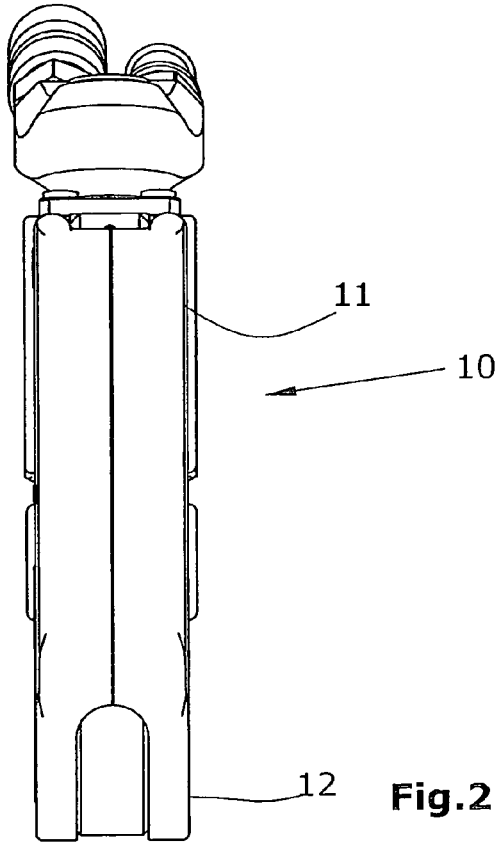
FIG. 2 is a front view in the direction of the arrow II in FIG. 1.
Figure 3:
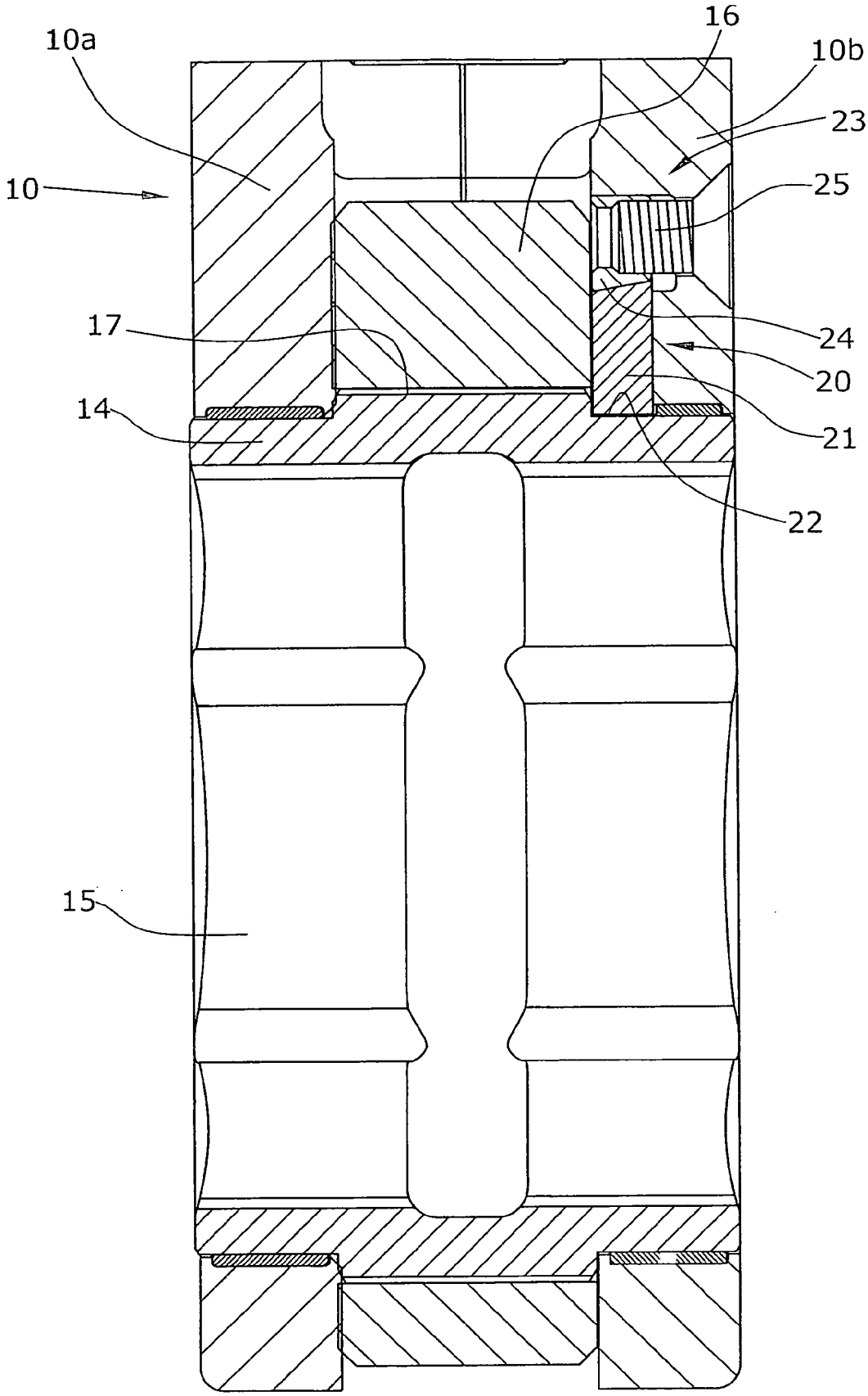
FIG. 3 is a sectional view along line III-III in FIG. 1.

The power wrench of the embodiment illustrated in FIGS. 1-3 has a housing 1 of a substantially L-shaped design and accommodating a drive portion 11 in one leg and a driven portion 12 in the other leg. The drive portion includes a hydraulic piston/cylinder unit (not illustrated) with a reciprocating piston rod. The piston rod drives a ratchet lever. The driven portion 12 includes a output shaft 14 supported in the housing, the output shaft being a hollow shaft (FIG. 3) with an internal hexagon profile 15. Situated between two sidewalls 10A, 10B of the housing 10 is the ratchet lever 16 coupled with an outer toothing of the output shaft 14 via a toothing 17. In a working stroke, the ratchet lever 16 takes the output shaft 14 along in one rotational direction, whereas it slides back empty during the return stroke. In this manner, the output shaft 14 is rotated at intervals.

The friction brake 20 has a friction shoe 21 arranged radially with respect to the output shaft 14 and pressing against a friction surface 22 at the circumference of the output shaft. A tensioning device 23 has a tensioning wedge 24 provided with a threaded bore into which a tensioning screw 25 is threaded that is retained in the housing wall 10B. By tightening the tensioning screw 25, the tensioning wedge 24 is pulled outward (to the right in FIG. 3), whereby it presses against a rear wedge face of the friction shoe 21 and urges the same forward towards the friction surface 22.

In the present instance, only a single friction shoe 21 is provided, however, a plurality of friction shoes can be provided that preferably are distributed uniformly along the circumference of the output shaft 14. The continuously operative friction brake 20 permanently applies a constant braking force on the output shaft while the output shaft rotates, so that the shaft is prevented from rotating backward.

Figure 5:
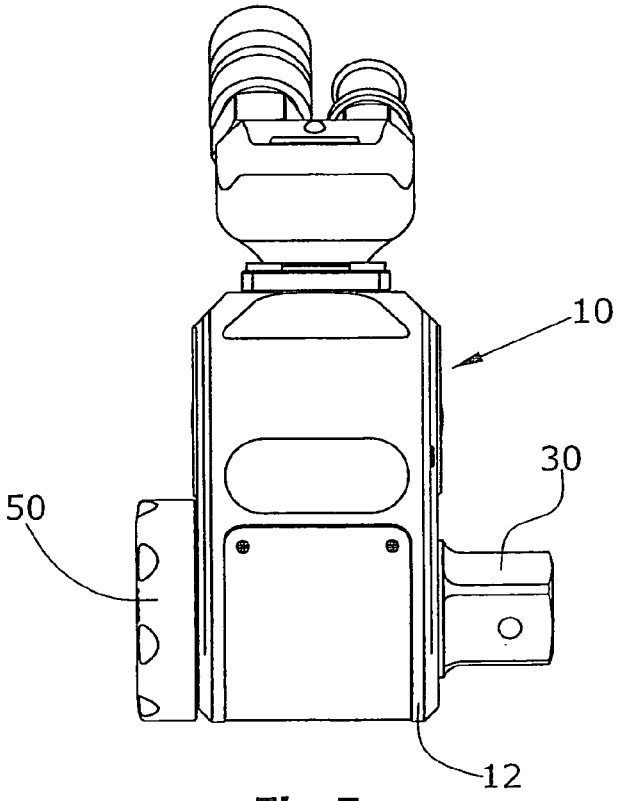
FIG. 5 is a front view of the power wrench in the direction of the arrow V in FIG. 4.
Figure 6:
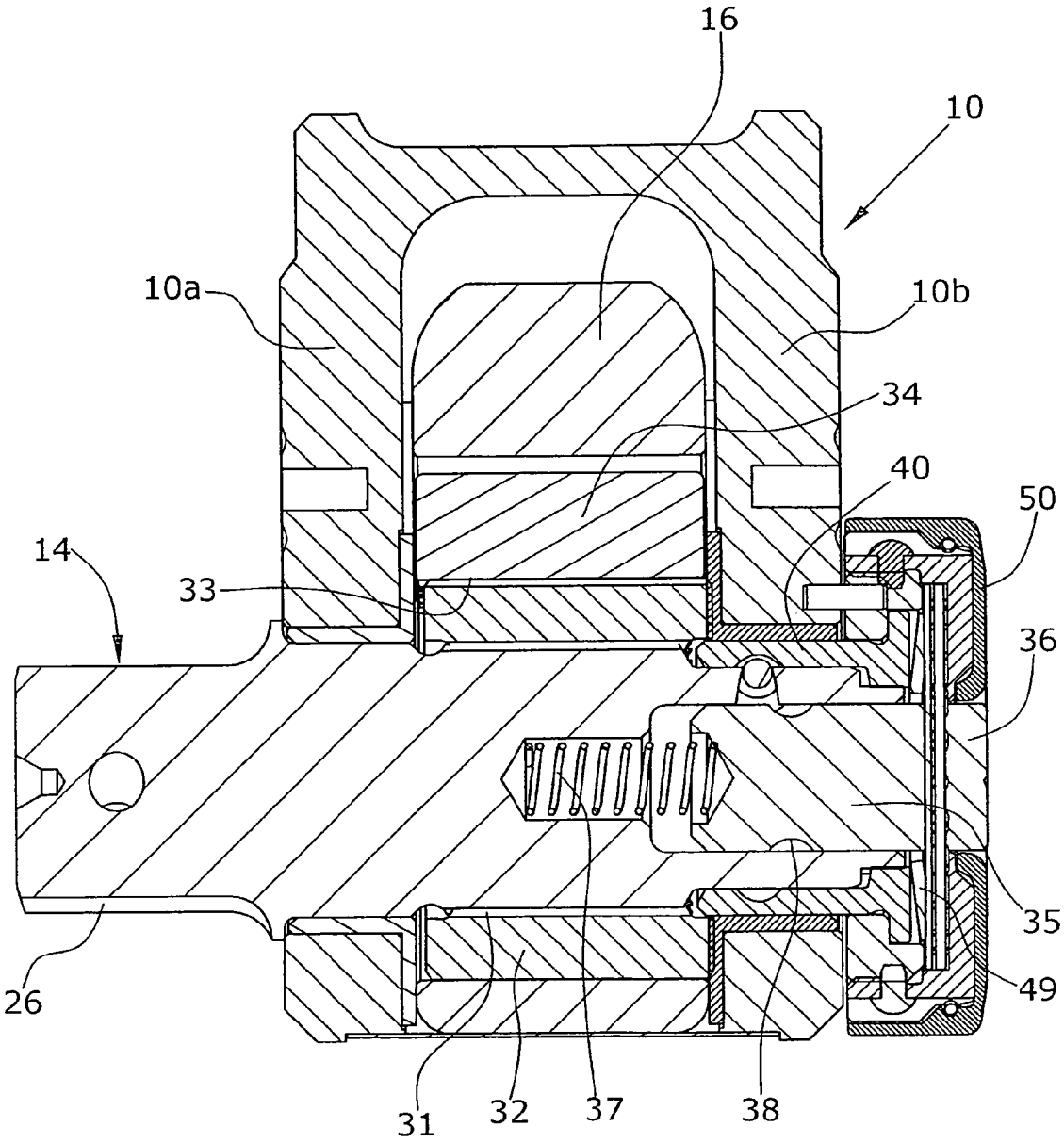
FIG. 6 is a sectional view along line VI-VI in FIG. 4.
Figure 7:
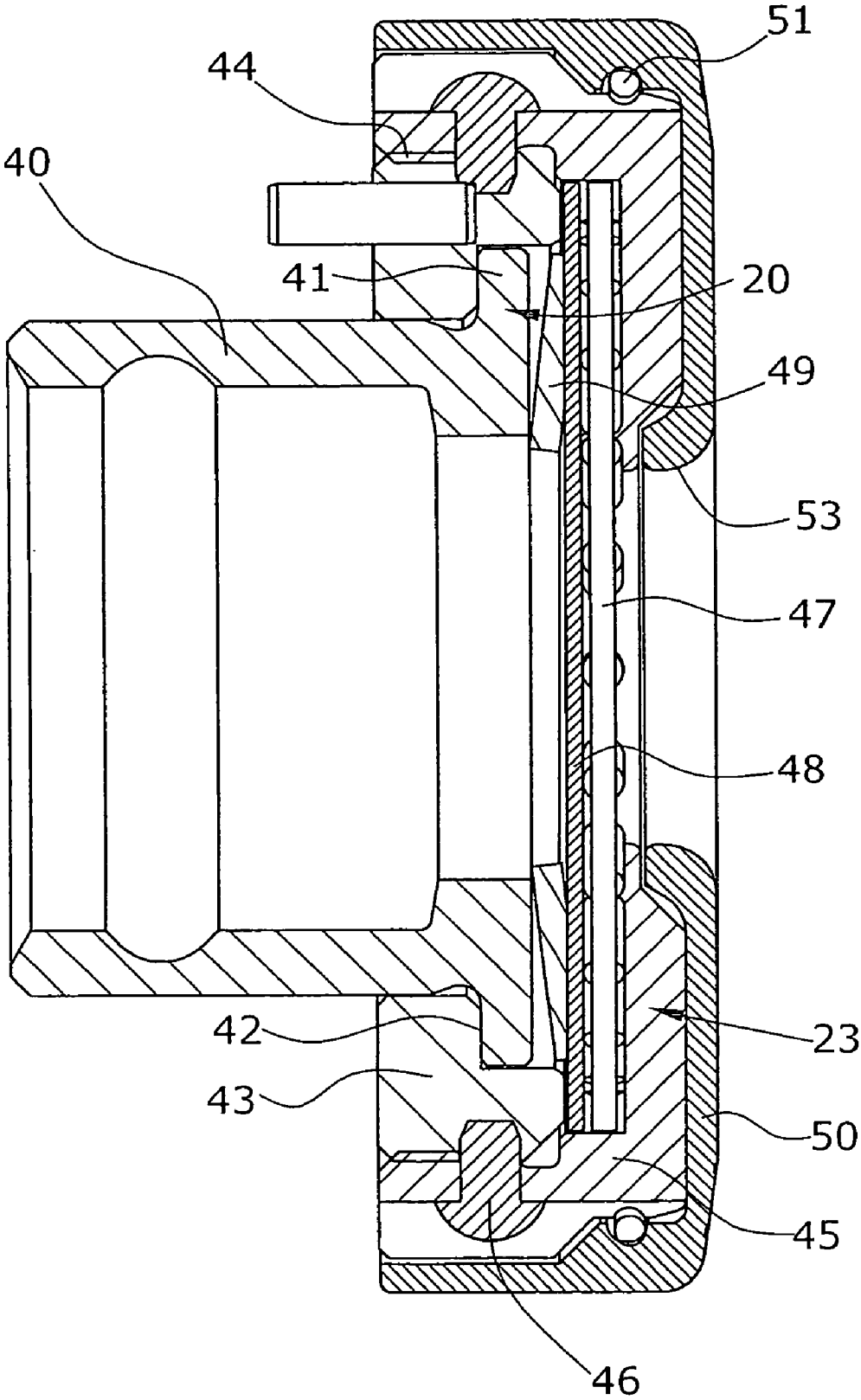
FIG. 7 is an enlarged illustration of a section through the friction brake and through the rotational angle display of the second embodiment.
Figure 8:
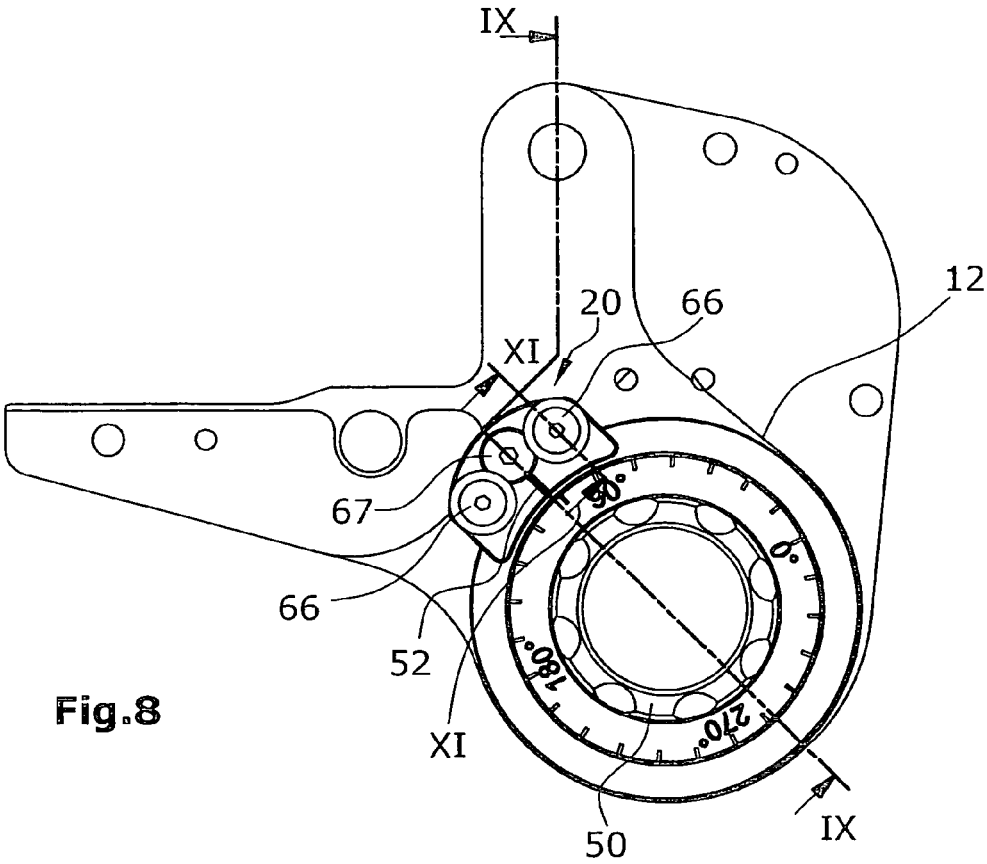
FIG. 8 is a side elevational view of a third embodiment.
Figure 9:
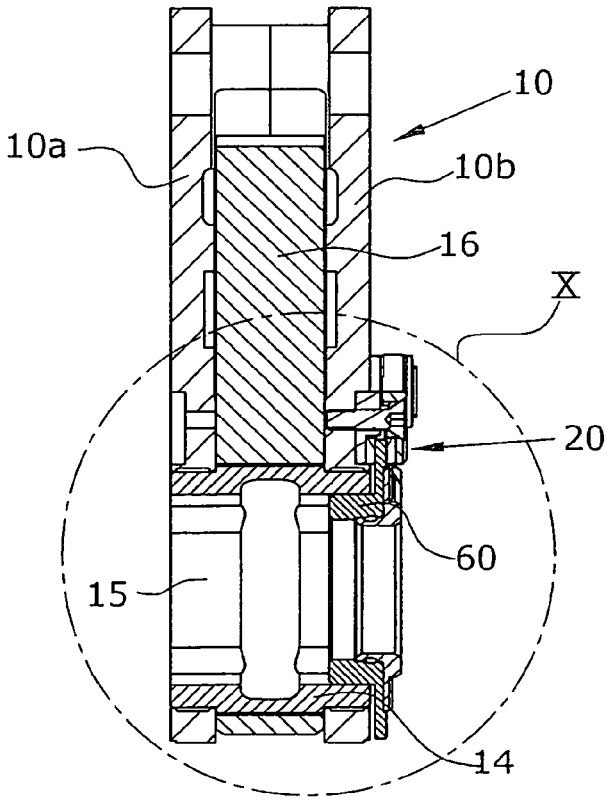
FIG. 9 is a sectional view along line IX-IX in FIG. 8.
Figure 10:
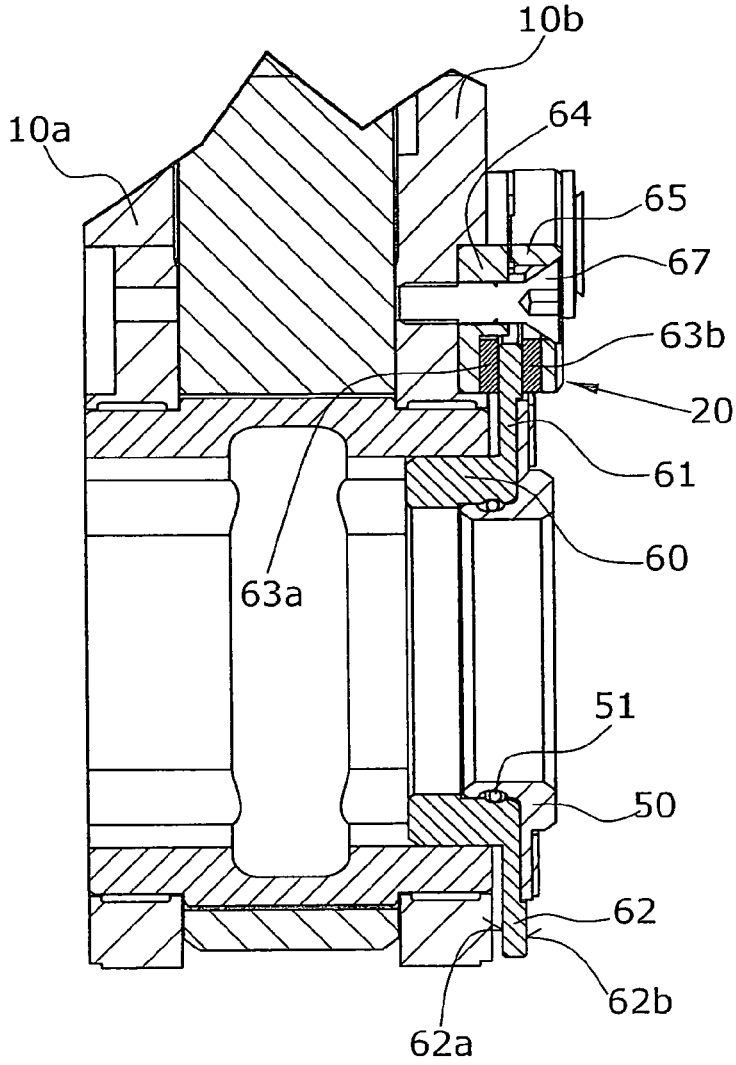
FIG. 10 is an enlarged illustration of the detail X of FIG. 9.
Figure 11:
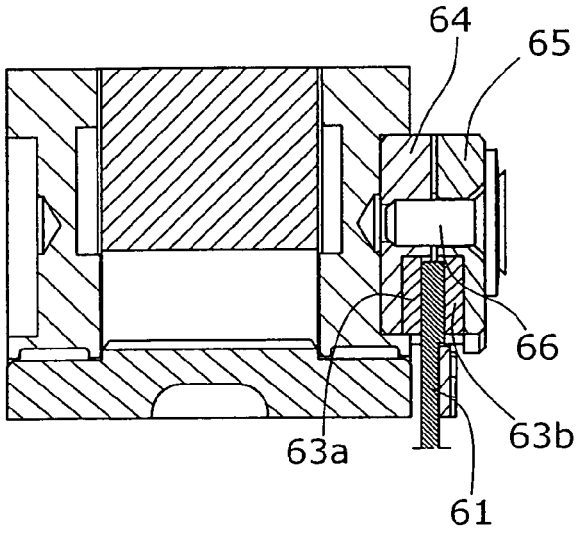
FIG. 11 illustrates a section through the tensioning device of the friction brake along the line XI-XI in FIG. 8.

In the embodiment illustrated in FIGS. 5-7, the housing 10 also includes a drive portion 11 and a driven portion 12. The cylindrical drive portion 11 is provided with a spline 30 onto which a supporting foot (not illustrated) may be set which is placed against a stationary counter bearing to prevent a rotation of the housing 10 while screwing.

Again, the housing 10 includes two parallel housing walls 10*a*, 10*b* with holes in which the output shaft 14 is supported. In this case, the output shaft 14 is solid and protrudes from one side of the housing 10, where the output shaft 14 is provided with a plug-on square 26 on which a socket wrench may be set. A sleeve 32 sits on a spline 31 of the output shaft 14 in a manner secured against rotation, the sleeve additionally being provided with an outer toothing 33. The toothing of a tappet member 34 meshes with this outer toothing, said tappet member being situated within the housing 10 and meshing with the ratchet lever 16. The reciprocating ratchet lever 16 drives the sleeve 32 and the output shaft 14 via the tappet member 34, the sleeve and the output shaft being taken along only in one direction of rotation.

A slide 35, whose front end wall 36 forms a push-button, slides in an axial recess of the output shaft 14. A spring 37 presses the slide 35 outward. The slide has a circumferential groove 38 that, with the slide pushed in, partly receives a ball 39 movable in an axial bore of the output shaft. Thereby, an intermediate sleeve 40 provided on a shank of the output shaft 14 is uncoupled from the output shaft so that the intermediate sleeve can be pulled off when the push-button 36 is pushed in.

As illustrated in FIG. 7, the intermediate sleeve 40, connected with the output shaft 14 in a manner secured against rotation, has a radial flange 41 at the outer end. The same presses against a friction surface 42 of an annular friction member 43 connected with the housing 10. The friction surface 42 may also be formed by a friction lining. Thus, the flange 41 forms a friction brake 20 together with the friction surface 42. The brake also comprises a plate spring 49 pressing the intermediate bushing 40 against the friction surface 42.

A swivel ring 45 sits on a thread 44 of the friction member 43, the ring being secured by means of a safety pin 46. The swivel ring 45 embraces a needle bearing 47 axially supported at the swivel ring 45 and, on the opposite side, pressing a disk 48 against the plate spring 49. In this manner, the swivel ring 45, together with the plate spring 49, is part of a tensioning device 23 for adjusting the friction force of the friction brake 20.

Figure 4:
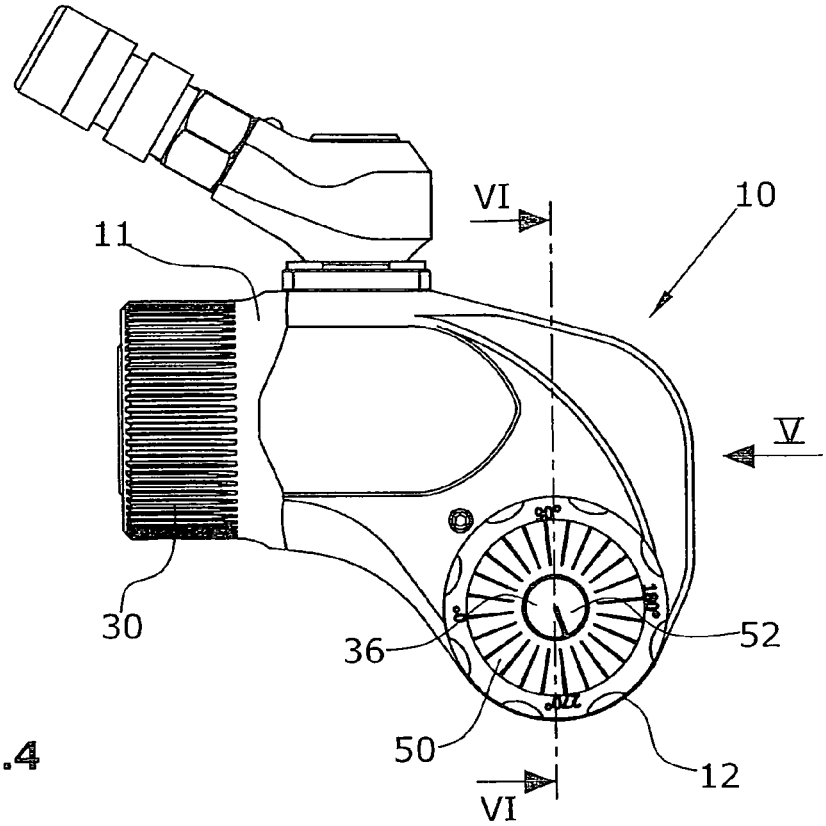
FIG. 4 is a side elevational view of a second embodiment.

An index ring 50 sits on the swivel ring 45, lockingly secured by means of an O-ring 51. The index ring 50 has an angle scale from 0° to 360°, visible in FIG. 4. The index ring is arranged at the housing 10 so as to be rotatable and concentric with the output shaft. It has a centric window 53 through which a mark 52 on the output shaft can be seen. It may be rotated—with some friction—on the swivel ring to any angular position so that the position 0° can be aligned with the mark 52 on the push-button 36. The push-button 36 is connected with the output shaft 14 in a manner secured against rotation and it thus indicates the respective rotational position of the screw as a relative position. The index ring 50 is set to zero manually in order to memorize the initial position. Thereafter, during the screwing operation, the mark 52 will wander corresponding to the progress of screwing, so that the user can read the respective rotational angle covered since the start of the screwing work or since another time during the screwing operation. The index ring, in combination with the mark 52 belonging to the output shaft, is of independent importance and is not linked to the presence of a friction brake.

The embodiment illustrated in FIGS. 8-11 includes a output shaft 14 rotatably supported between the housing walls 10*a* and 1*b* and having an outer toothing (not illustrated) engaged by a reciprocating ratchet lever 16. The output shaft 14 has an internal hexagon profile 15. From one end thereof (from the left in FIGS. 9 and 10), a screw head is inserted, while the friction brake 20 and the index ring 50 are provided at the opposite (right) end. The friction brake 20 comprises a friction member 60 with a bushing connected with the hollow output shaft 14 in a manner secured against rotation. An annular friction disc 61 protrudes radially from the bushing, the disk having a circumferential portion 62 with two radial friction surfaces 62*a* and 62*b*. These friction surfaces are engaged by friction linings 63*a*, 63*b* of the friction brake 20. The friction lining 63*a* is mounted to an inner brake jaw 64 and the friction lining 63*b* is mounted to an outer brake jaw 65, the brake jaws facing each other in parallel and clamp the edge 62 of the friction member 60 between them. The clamping effect is caused by two tensioning screws 66 (FIG. 8) that pull the brake jaws 64 and 65 against each other and which are adjustable to set the braking force of the friction brake 20. A retaining screw 67 is situated between the two tensioning screws 66, which is threaded into the housing wall 10*b* and keeps the friction brake 20 on the housing 10.

In the third embodiment, the friction brake 20 is designed in the manner of a calliper brake, the two brake jaws 64, 65 forming a calliper straddling the edge of the friction disc 61 with the friction linings 63*a*, 63*b*.

Although a preferred embodiment of the invention has been specifically illustrated and described herein, it is to be understood that minor variations may be made in the apparatus without departing from the spirit and scope of the invention, as defined by the appended claims.

What is claimed is:

1. A power wrench comprising:

a drive portion including a hydraulic cylinder and a driven portion, the driven portion comprising an output shaft rotatably supported in the housing and configured to be rotated at intervals by a ratchet lever;

a continuously active friction brake located in the housing, the continuously active friction brake being in contact with and applying a friction force between the output shaft and the housing, the friction brake having at least one friction shoe being oriented substantially radially with respect to the output shaft and one end of the friction shoe pressing against a circumferential friction surface of the output shaft; and a plurality of circumferentially arranged friction shoes, with one end of each of the plurality of the circumferentially arranged friction shoes being pressed against the output shaft by an associated adjustable tensioning device, and each associated adjuctable tensioning device comprising a tensioning wedge and an adjustable tensioning screw, the adjustable tensioning screw being arranged substantially orthogonal to another end of its associated friction shoe.

2. A power wrench comprising:

a drive portion including a hydraulic cylinder and a driven portion, the driven portion comprising an output shaft rotatably supported in the housing and configured to be rotated at intervals by a ratchet lever;

a continuously active friction brake located in the housing, the continuosly active friction brake being in contact with and applying a friction force between the output shaft and the housing, the friction brake having at least one friction shoe being oriented substantially radially with respect to the output shaft and one end of the friction shoe pressing against a circumferential friction surface of the output shaft: and a plurality of circumstantially arranged friction shoes, the at least one friction shoe being pressed against the output shaft by an adjustable tensioning device, the adjustable tensioning device comprising an adjustable tensioning screw arranged substantially orthogonal to the at least one friction shoe, and a tensioning wedge.

3. A power wrench comprising:

a housing comprising:

a drive portion with a hydraulic cylinder;

a driven portion, the driven portion comprising an output shaft rotatably supported in the housing;

a ratchet lever driveably connected to the hydraulic cylinder; and a continuously active friction brake comprising at least one friction shoe oriented substantially radially with respect to and having one end that presses against a circumferential friction surface of the output shaft, an adjustable tensioning screw located adjacent and oriented substantially orthogonally to an opposite end of the at least one friction shoe, and a tensioning wedge moveably located between the adjustable tensioning screw and the opposite end of the at least one friction shoe.

4. The power wrench of claim 3, wherein the continuously active friction brake comprises a plurality of circumferentially arranged friction shoes.

5. The power wrench of claim 4, wherein the continuously active friction brake further comprises a plurality of tensioning devices.

6. The power wrench of claim 5, wherein each one of the plurality of tensioning devices is associated with a single one of the plurality of circumferentially arranged friction shoes.

7. The power wrench of claim 6, wherein each of the plurality of tensioning devices comprises another adjustable tensioning screw and another tensioning wedge.

8. A power wrench comprising:

a housing comprising:

a drive portion with a hydraulic cylinder;

a driven portion, the driven portion comprising an output shaft rotatably supported in the housing;

a ratchet lever driveably connected to the hydraulic cylinder; and a continuously active friction brake comprising at least one friction shoe oriented substantially radially with respect to and having one end that presses against a circumferential friction surface of the output shaft, a non-spring biased, adjustable tensioning device located adjacent and oriented substantially orthogonally to an opposite end of the at least one friction shoe, the non-spring biased, adjustable tensioning device comprising an adjustable tensioning screw located substantially orthogonally to the opposite end of the at least one friction shoe, and a tensioning wedge moveably located between the adjustable tensioning screw and the opposite end of the at least one friction shoe.

* * * * *

UNITED STATES PATENT AND TRADEMARK OFFICE

CERTIFICATE OF CORRECTION

PATENT NO. : 8,024,996 B2
APPLICATION NO. : 12/225433
DATED : September 27, 2011
INVENTOR(S) : Wagner et al.

It is certified that error appears in the above-identified patent and that said Letters Patent is hereby corrected as shown below:

ON THE TITLE PAGE:

Item (73) Assignee: Please delete "Wanger" and replace with --Wagner--.

Signed and Sealed this
Twenty-second Day of November, 2011

David J. Kappos

David J. Kappos
*Director of the United States Patent and Trademark Office*